US008620821B1

(12) United States Patent
Goldberg et al.

(10) Patent No.: US 8,620,821 B1
(45) Date of Patent: Dec. 31, 2013

(54) SYSTEMS AND METHODS FOR SECURE PARCEL DELIVERY

(75) Inventors: Robert M. Goldberg, Briarcliff Manor, NY (US); Leon A. Pintsov, West Hartford, CT (US); Mark D. Irwin, Wilmette, IL (US)

(73) Assignee: Pitney Bowes Inc., Stamford, CT (US)

( * ) Notice: Subject to any disclaimer, the term of this patent is extended or adjusted under 35 U.S.C. 154(b) by 1482 days.

(21) Appl. No.: 10/604,935

(22) Filed: Aug. 27, 2003

Related U.S. Application Data

(60) Provisional application No. 60/319,493, filed on Aug. 27, 2002.

(51) Int. Cl.
*B07C 1/00* (2006.01)

(52) U.S. Cl.
USPC ..... 705/60; 705/62; 705/64

(58) Field of Classification Search
USPC ..... 705/26, 28, 401, 406, 710, 410, 60; 700/226; 235/462
See application file for complete search history.

(56) References Cited

U.S. PATENT DOCUMENTS

| | | | | | |
|---|---|---|---|---|---|
| 5,072,400 | A | * | 12/1991 | Manduley | 700/226 |
| 5,119,306 | A | * | 6/1992 | Metelits et al. | 705/406 |
| 5,175,692 | A | | 12/1992 | Mazouz et al. | 700/217 |
| 5,253,165 | A | | 10/1993 | Leiseca et al. | 705/5 |
| 5,319,560 | A | * | 6/1994 | Adams et al. | 701/120 |
| 5,322,977 | A | * | 6/1994 | Manduley et al. | 177/25.15 |
| 5,324,893 | A | * | 6/1994 | Manduley et al. | 177/25.15 |
| 5,340,968 | A | * | 8/1994 | Watanabe et al. | 235/380 |
| 5,377,120 | A | * | 12/1994 | Humes et al. | 700/224 |
| 5,388,049 | A | * | 2/1995 | Sansone et al. | 705/406 |
| 5,424,944 | A | * | 6/1995 | Kelly et al. | 705/28 |
| 5,440,669 | A | * | 8/1995 | Rakuljic et al. | 359/7 |
| 5,501,571 | A | | 3/1996 | Van Durrett et al. | 414/801 |
| 5,557,096 | A | * | 9/1996 | Watanabe et al. | 235/492 |
| 5,600,303 | A | * | 2/1997 | Husseiny et al. | 340/568.1 |
| 5,600,700 | A | * | 2/1997 | Krug et al. | 378/57 |
| 5,692,029 | A | * | 11/1997 | Husseiny et al. | 378/88 |
| 5,822,533 | A | * | 10/1998 | Saito et al. | 709/224 |
| 5,844,807 | A | | 12/1998 | Anderson et al. | 700/217 |
| 5,918,266 | A | * | 6/1999 | Robinson | 73/37.5 |
| 5,974,111 | A | * | 10/1999 | Krug et al. | 378/57 |
| 5,998,752 | A | * | 12/1999 | Barton et al. | 209/583 |
| 6,032,138 | A | * | 2/2000 | McFiggans et al. | 705/410 |
| 6,035,289 | A | | 3/2000 | Chou et al. | 705/37 |
| 6,064,995 | A | * | 5/2000 | Sansone et al. | 705/410 |
| 6,085,182 | A | * | 7/2000 | Cordery | 705/408 |
| 6,112,193 | A | * | 8/2000 | Dlugos et al. | 705/408 |
| 6,141,654 | A | * | 10/2000 | Heiden et al. | 705/408 |
| 6,154,733 | A | * | 11/2000 | Pierce et al. | 705/408 |
| 6,173,274 | B1 | * | 1/2001 | Ryan, Jr. | 705/408 |
| 6,233,568 | B1 | * | 5/2001 | Kara | 705/410 |

(Continued)

OTHER PUBLICATIONS

Formal Security Proofs for aSignature Scheme with Partial Message Recovery, Daniel R. L. Brown and Don B. Johnson, Jun. 14, 2000.*

*Primary Examiner* — Evens J Augustin
(74) *Attorney, Agent, or Firm* — Steven J. Shapiro; Charles R. Malandra, Jr.

(57) ABSTRACT

A method and system for secure package delivery utilizing digital signatures is described. In one configuration, data regarding the weight, dimensions and origination are cryptographically processed to create an authentication digital signature with message retrieval capability. The data is read and independently verified at the package destination.

14 Claims, 4 Drawing Sheets

(56) References Cited

U.S. PATENT DOCUMENTS

| | | | | |
|---|---|---|---|---|
| 6,285,916 | B1 * | 9/2001 | Kadaba et al. | 700/222 |
| 6,298,013 | B1 * | 10/2001 | Berlin et al. | 368/10 |
| 6,332,098 | B2 * | 12/2001 | Ross et al. | 700/226 |
| 6,408,286 | B1 * | 6/2002 | Heiden | 705/408 |
| 6,427,021 | B1 * | 7/2002 | Fischer et al. | 382/101 |
| 6,429,810 | B1 * | 8/2002 | De Roche | 342/357.07 |
| 6,523,117 | B2 * | 2/2003 | Oki et al. | 713/189 |
| 6,525,329 | B1 * | 2/2003 | Berman | 250/556 |
| 6,539,360 | B1 * | 3/2003 | Kadaba | 705/28 |
| 6,628,899 | B1 * | 9/2003 | Kito | 396/56 |
| 6,707,879 | B2 * | 3/2004 | McClelland et al. | 378/57 |
| 6,735,630 | B1 * | 5/2004 | Gelvin et al. | 709/224 |
| 6,827,265 | B2 * | 12/2004 | Knowles et al. | 235/462.01 |
| 7,035,832 | B1 * | 4/2006 | Kara | 705/408 |
| 2001/0024157 | A1 * | 9/2001 | Hansmann et al. | 340/10.41 |
| 2002/0028009 | A1 * | 3/2002 | Pomata et al. | 382/131 |
| 2002/0032573 | A1 * | 3/2002 | Williams et al. | 705/1 |
| 2002/0065738 | A1 * | 5/2002 | Riggs et al. | 705/26 |
| 2002/0067267 | A1 * | 6/2002 | Kirkham | 340/572.7 |
| 2002/0087371 | A1 | 7/2002 | Abendroth | 705/7 |
| 2002/0103724 | A1 * | 8/2002 | Huxter | 705/28 |
| 2002/0178074 | A1 * | 11/2002 | Bloom | 705/26 |
| 2003/0042309 | A1 * | 3/2003 | Tsikos et al. | 235/454 |
| 2004/0128254 | A1 * | 7/2004 | Pintsov | 705/62 |
| 2005/0017488 | A1 * | 1/2005 | Breed et al. | 280/735 |

* cited by examiner

SYSTEMS AND METHODS FOR SECURE PARCEL DELIVERY

CROSS REFERENCE TO RELATED APPLICATIONS

This application claims priority under 35 U.S.C. section 119(e) from Provisional Patent Application Ser. No. 60/319,493, filed Aug. 27, 2002, entitled Systems And Methods For Secure Parcel Delivery, which is incorporated herein by reference in its entirety.

BACKGROUND OF INVENTION

The illustrative embodiments disclosed in the present application are useful in systems including those for providing parcel delivery and more particularly are useful in systems including those for providing for secure parcel delivery via air cargo transportation channels.

Millions of packages are shipped by airfreight each year. Air cargo shipments are often time sensitive and originate from many shippers. Additionally, freight forwarders or other freight agents are often involved. Air cargo is often transported in the cargo holds of passenger aircraft during passenger flights throughout the world. Air cargo is typically sold in terms of a combination of volume and weight characteristics of the goods to be shipped. Accordingly, the supply chain is very complicated and issues such as safety and security are important concerns. Accordingly, known consignors and regulated agents are currently preferred for security reasons.

SUMMARY OF INVENTION

The present application describes systems and methods for providing secure parcel delivery. In one embodiment, package parameters are obtained and data relating to the parameters is associated with the package such that a change in the parameter can be detected using the related data. In a further embodiment, the package parameters include physical dimensions such as weight and the related data is secured using cryptographic techniques.

DETAILED DESCRIPTION

Figure 1:
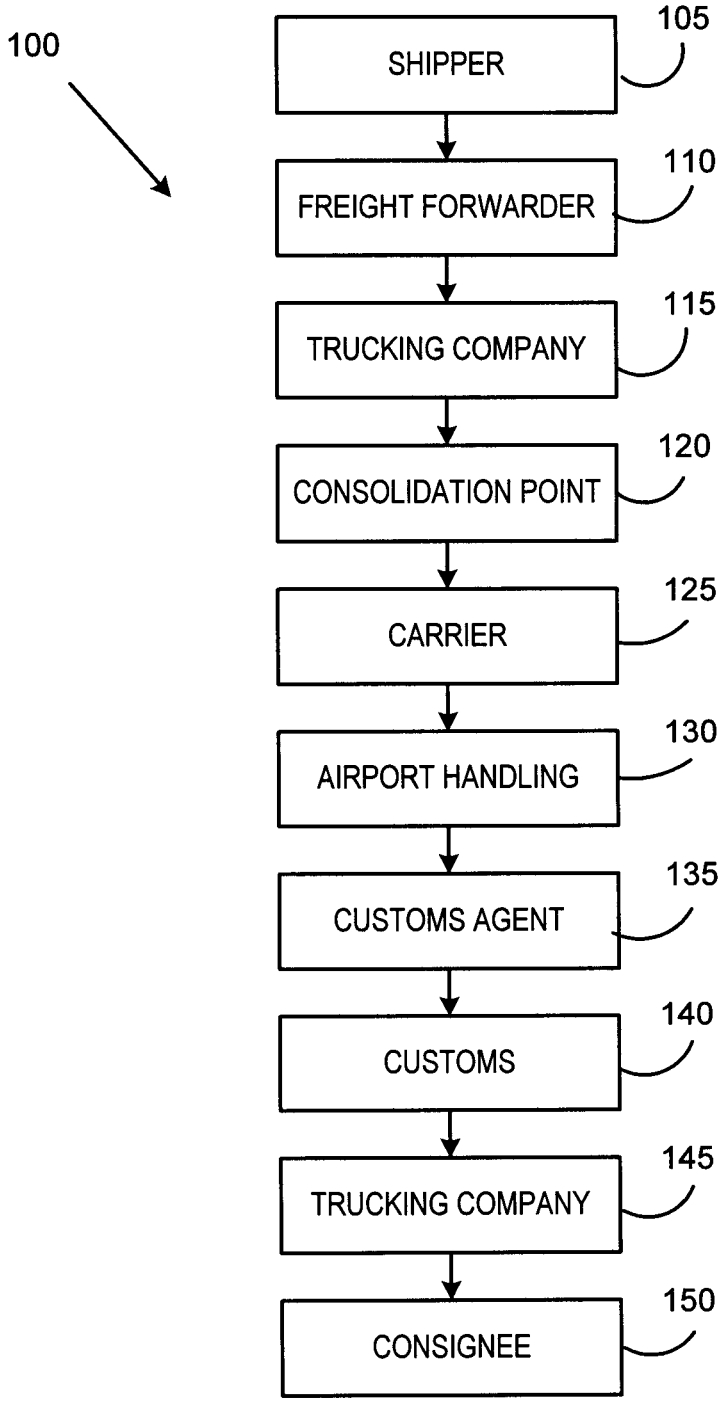
FIG. 1 is a schematic representation of a supply chain according to an illustrative embodiment of the present application.

Air cargo security systems may include screening technologies to detect hazards such as explosives and bio/chemical hazards. Such screening technologies may include threat detection techniques such as metal detection, x-ray scanning, Explosives detection and physical searching by hand or using canines. Similarly, explosion containment containers may be utilized to contain explosions in a cargo hold.

Additionally, information based security systems, cargo transfer optimization systems and safety systems may be utilized. Furthermore, advanced capacity utilization and logistic system infrastructure may be utilized.

Referring to FIGS. 1-4, a system for secure delivery of parcels is described. A shipping object may comprise a box, parcel, container, pallet or other object. Such shipping objects are typically shipped from a source company through shipping agents to a destination. The systems described herein may be used to detect dangerous materials and prevent shipment of dangerous materials. However, the systems described may also be used to trace activity such as criminal activity should dangerous materials elude detection. In such situations, the system may be used to provide non-repudiation in an attempt to generate legally admissible evidence of wrongdoing. For example, using digitally signed records at each agent in a logistics chain, it may be possible to pinpoint a specific location or time in a logistics path at which a package was replaced or tampered with.

Several security approaches are described herein and they may be used together or independently. In alternatives, certain aspects of each approach or combination may be omitted.

In a first approach, the system authenticates the source of a parcel and then decides whether to trust that the parcel is safe. Alternatively, the system may apply levels of trust based upon data relating to the source such as past incident data. For example, if a particular source has shipped spoiled goods a few times in the past, that source may be deemed not to be as trustworthy as a source that has never shipped spoiled goods. The duration of time that has lapsed since the last questionable transaction may also be a factor. Each intermediate source may be separately authenticated.

In a second approach, the path of the shipping object is secured. The system attempts to thwart attacks on the package including substitution attacks, addition attacks, replacement attacks and any violation of the integrity of the package. One approach includes placing a secret message on the package or at checkpoints in the delivery path. While only a trusted source would know the secret, the secret may be intercepted and duplicated. The duplicated secret might then be used on a replacement package containing hazardous materials.

In one alternative, data relating to the package is securely stored with the package and checked at checkpoints along the delivery path. For example, each agent in the shipping path may obtain package data and verify the package data stored with the package. In another alternative, each agent adds to a list of related data records as the package travels from agent to agent along the route.

Data relating to the package comprises the size, weight and density of the package. Package measurement systems are known and not described in detail herein. In an alternative, a response signature related to the package is stored as related package data. For example, the package response to a particular x-ray source is stored. A similar source may then be used at the destination or along the path to verify that the same signature securely stored with the package is received. Other sources may be utilized including but not limited to gamma ray and ultrasound.

In another alternative, each agent may securely record on the package the time that a package arrives and departs from a particular waypoint. RF-ID systems may be utilized to record change of control, time and location tracking information. Such transportation path related data is also stored with the package and may be securely stored on an RF-ID tag with the package. Other storage technologies may also be used.

Security techniques such as authentication, non-repudiation and secure transmission techniques are known. Certain secure digital signature techniques allow at least some of the secure message to be retrieved from the signature. The retrieved message may include data relating to the package. The data relating to the package may also be encrypted. However, the data relating to the package may be sent in the clear as the signature authenticates it. For example, digital signature techniques allowing message recovery are known including the PintsovVanstone based digital signature systems described in IEEE draft standard P1363A. Accordingly, the package related data such as the x-ray signature is not hashed and is retrievable from the digital signature.

RF-ID tag systems may be used to record and protect change of control in the delivery path from the source to the destination. For example, commonly owned, co-pending U.S. patent application Ser. No. 10/238,864 filed Sep. 10, 2002 entitled Method For Maintaining The Integrity Of A Mailing Using Radio Frequency Identification Tags is incorporated herein by reference.

Referring to FIG. 1, a schematic representation of a supply chain 100 according to an illustrative embodiment of the present application is shown. A trusted shipper 105 utilizes a Freight Forwarder 110. The Freight Forwarder 110 utilizes a Trucking Company 115 to deliver the parcels to a consolidation point 120 for a carrier 125. The parcel is shipped using the carrier 125 and airport handling systems 130. The package clears customs using a customs agent 135 and the parcel is then sent by truck 145 to its final destination at the Consignee location 150. The supply chain described here is illustrative and many alternatives for delivering a shipping object from a source to a destination may be used.

In the product supply chain, the goods move from the shipper to the consignee as organized by the shipper or the freight forwarder. In the related information/document supply chain, the information supply chain deals with the way in which shipping information is entered, used and stored. The related financial supply chain is characterized by the flow of money between commercial partners and other third-party participants.

Figure 2:
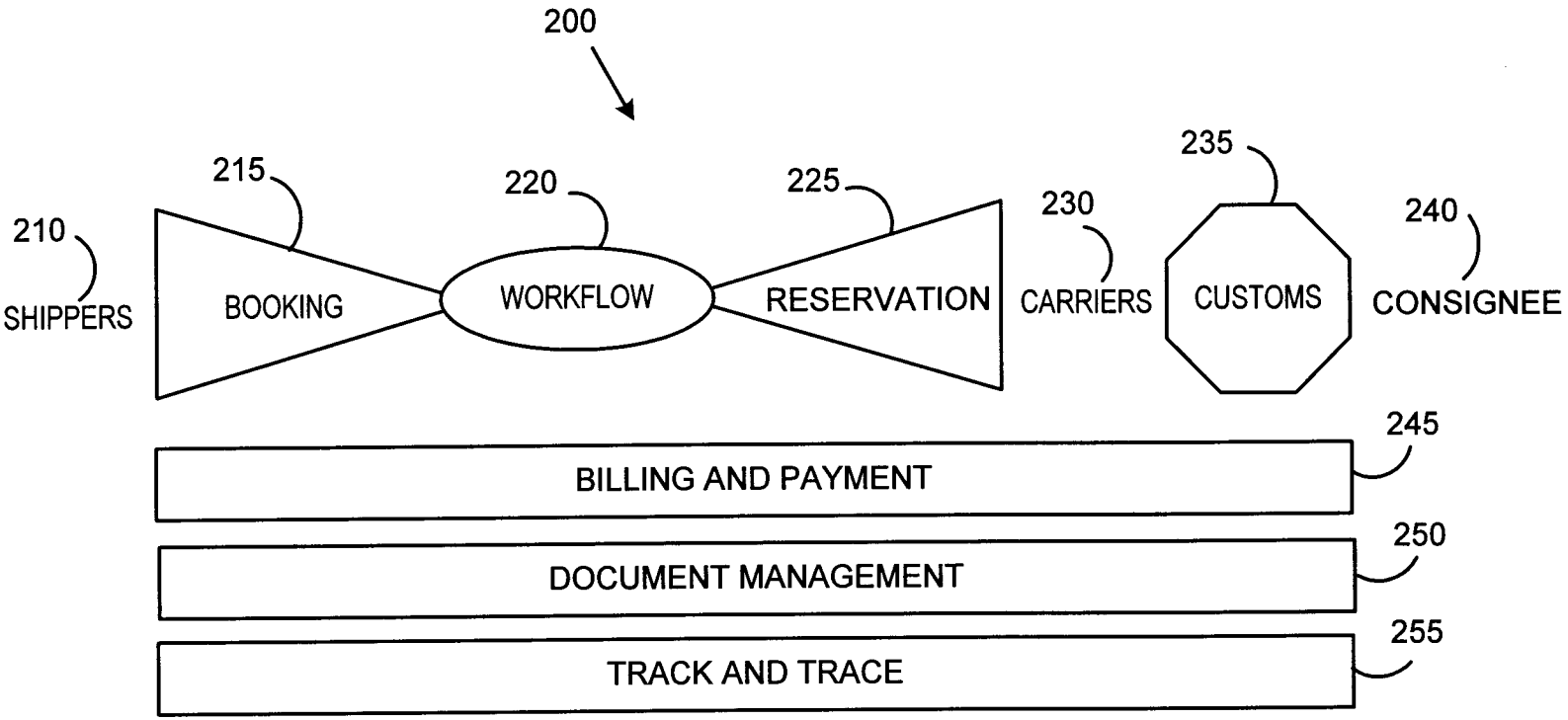
FIG. 2 is a schematic representation of a shipping logistics information flow according to another illustrative embodiment of the present application.

Referring to FIG. 2, a schematic representation of a shipping logistics information flow according to another illustrative embodiment of the present application is shown. An illustrative end-to-end delivery chain is described in a shipper"s network that is not integrated. From the perspective of the carrier, the shipper must reserve capacity so that the parcel may be delivered to the consignee. Here, billing issues from the shipper to the various Freight Forwarders and other vendors are a concern and there are shipping system inefficiencies.

The shippers obtain parcel related data such as the size, weight and density of the package and securely store the information in a bar code on the package. The consignee then receives the package and bar code. The consignee reads the data from the bar code and independently verifies the package related data. If the data is not verified, the package is quarantined for further processing using physical hazard detection scanning devices. If the data is not verified, an incident report is generated and associated with the shipper and any intermediary agents.

The shippers 110 use a booking system 215 to place parcels or other shipping items into the workflow system 220. The workflow system 220 then uses a reservation system 225 to reserve transportation space with carriers 230. The carriers then ship the parcels though customs 235 if necessary. The parcels are then delivered to the consignee 240.

In an alternative, the package related data is verified at intermediate steps along the shipping route. The billing and payment subsystem 245 uses intermediate verification of package related data to ensure that a package has arrived in good condition at an intermediate point. The intermediate carrier that transported the package to the intermediate destination is then paid without having to submit a bill for the service.

In an alternative, the document management function 250 uses RF-ID storage tags to store shipping manifests that are digitally signed for authentication and non-repudiation.

In an alternative, the track and trace function 255 includes time and location information that is securely stored with the package using digital signatures with message retrieval.

While there is some inefficiency in the logistics system described, the security systems described herein provide increased parcel security without the need to reorganize the shipping infrastructure.

In an alternative, each intermediate shipping point is considered a source and a destination and each section of the transport path is independently verified as a separate transaction.

Figure 3:
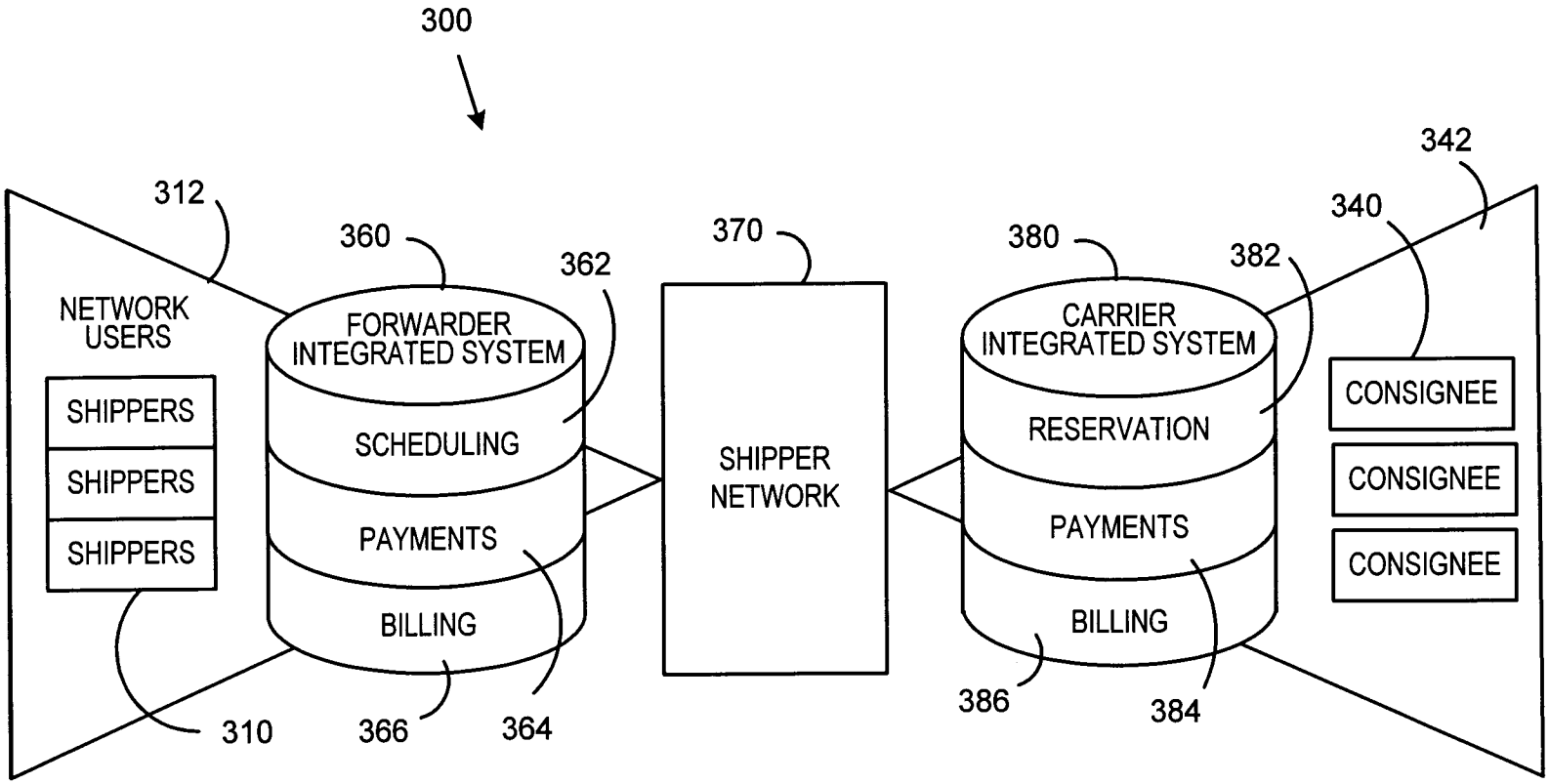
FIG. 3 is a schematic representation of an integrated shipping solution system according to another illustrative embodiment of the present application.

Referring to FIG. 3, a schematic representation of an integrated shipping solution system 300 according to another illustrative embodiment of the present application is shown. An end-to-end delivery chain is described in an integrated shipper"s network. From the perspective of the carrier, forwarder, shipper or consignee, the shipper network provides greater visibility and tracking.

The front-end framework 312 has a wide input of many shippers 310 that funnel packages and information to a forwarder integrated system 360. The forwarder integrated system includes a scheduling system 362, a payments system 364 and a billing system 366.

The shipping front-end 312 then connects to the central shipper network 370 that provides the interface between the shipping front-end 312 and the back-end destination framework 342.

The back-end destination framework 342 includes at least one carrier-integrated system 380. The carrier-integrated system 380 includes a reservation system 382, a payments system 384 and a billing system 386. The output of the back-end framework 342 is a wide group of destinations such as consignees 340.

Figure 4:
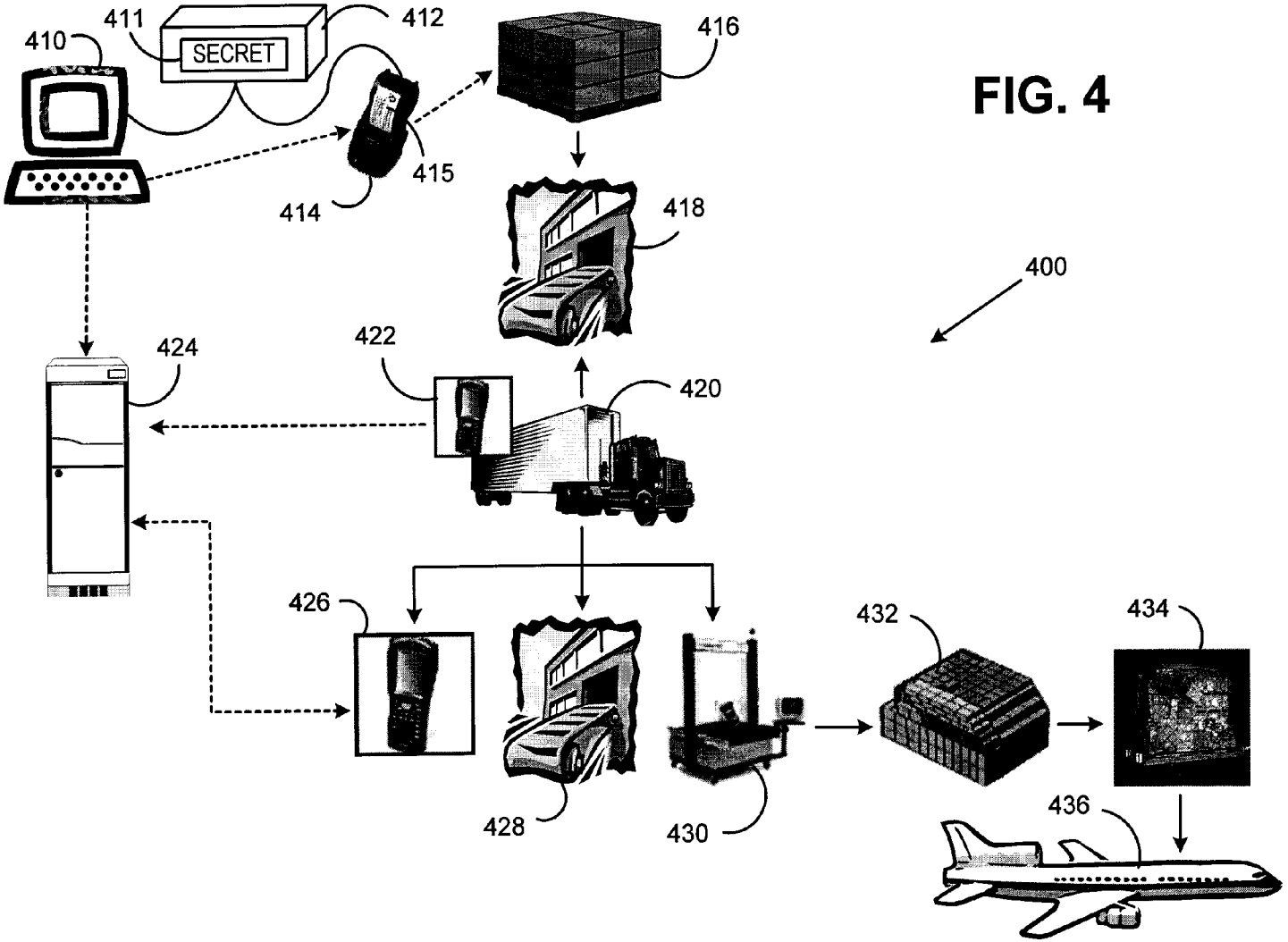
FIG. 4 is a schematic representation of a shipping system according to another illustrative embodiment of the present application.

Referring to FIG. 4, a schematic representation of a shipping system 400 according to another illustrative embodiment of the present application is shown. An end-to-end delivery chain describing security and safety features is described. There are several points of change of control of the parcels shown in the illustrative distribution segment shown in FIG. 4.

A trusted shipper 410 places a secret 411 on the parcel 412. The shipper may use handheld computer and printer 414 to print a secure label 415 having the secret. The label 415 is then placed on the parcel 412. The parcel is placed on a skid of parcels to be shipped 416. The skid of parcels 416 is transported 418 to a local carrier 420. A handheld computer 422 is used to scan the secret. The handheld computer 422 then contacts a central server 424 to verify the authenticity of the package. The local carrier 420 delivers the pallet 416 to the receiving area of the long distance carrier 428. A handheld computer 426 communicates with the central server 424 to verify the parcels. If the verification provides a low indication of reliability, the parcels are physically scanned for hazards using a scanner. The parcels are weighed and scanned for dimension using module 430. The parcels are then placed in a shipping pallet 432. When the pallet is closed to any new parcel additions, it is finalized 434 and loaded onto the long haul carrier 436.

In an alternative, the secret also includes or is replaced by data relating to the parcel such as size, weight, density and response signature to an x-ray. All or portions of the data relating to the parcel may be verified at intermediate steps. The weighing and dimension scanner 430 may be used to verify the data relating to the parcel that is placed on the label.

In this embodiment, a shipper may be allowed access to or visibility to the capacity of a particular carrier. Alternatively, the carrier may not share that information as part of the bid process. The carrier will typically prefer to achieve full capacity to increase margins by increasing revenue at the cost of the same plane trip. Accordingly, the system utilizes capacity utilization optimization to increase efficiency by using cubing systems for optimizing volume characteristics. In the air cargo industry, weight is a paramount issue, as increased weight requires more fuel.

In a system having trusted senders, there are at least two threats that a wrongdoer might employ during the chain of custody when the package passes from the trusted sender to the air cargo operator. First, the package may be replaced or modified. Secondly, an additional package may be added into the package stream.

Several Palletization systems have been described. For example, a reference directed toward an Automated Palletizing System is described in U.S. Pat. No. 5,501,571, issued Mar. 26, 1996 and incorporated herein by reference.

Certain staging systems using radio frequency tag have been described. For example, a reference directed toward Methods for Shipping Freight is described in U.S. Pat. No. 6,332,098, issued Dec. 18, 2001 and incorporated herein by reference.

Certain shipping commerce systems have been described. For example, a reference directed toward Reservations and Scheduling is described in U.S. Pat. No. 5,253,165, issued Oct. 12, 1993 and incorporated herein by reference. A reference directed toward Electronic Trading of Carrier Cargo Capacity is described in U.S. Pat. No. 6,035,289, issued Mar. 7, 2000 and incorporated herein by reference. A reference directed toward E-Commerce Freight Management is described in United States Patent Application Publication No. 2002/0087371A1, published Jul. 4, 2002 and incorporated herein by reference.

A reference directed toward Integrated Air Logistics Systems is described in U.S. Pat. No. 6,429,810, issued Aug. 6, 2002 and incorporated herein by reference.

Certain palletizing systems have been described. For example, a reference directed toward Palletizing Randomly Arriving Mixed Size and Content Parcels is described in U.S. Pat. No. 5,175,692, issued Dec. 29, 1992 and incorporated herein by reference. A reference directed toward Automated Optimizing and Palletizing is described in U.S. Pat. No. 5,844,807, issued Dec. 1, 1998 and incorporated herein by reference.

Air cargo automation systems include Champ Cargo Systems, TOPS Maxload and Logiplan.

In this illustrative embodiment of the present application, the pallet optimization system is provided access to information regarding packages that are likely to appear in its input stream before they are actually scanned in a weighing, dimensioning and scanning module 430. For example, a reservation system may process packages that are to be shipped. The information regarding the package includes weight and load characteristic information as well as dimensional information and stacking information including how much weight can be stacked on the item. Alternatively, 3D optical laser scanning dimensioning systems such as those available from VolScan of Bristol England may be utilized.

Referring to FIG. 4, weight, dimensions and other sources of information are encoded within the information device such as a bar code or RF ID tag placed on parcel 412. In one embodiment, a secure hash or digital signature is created using the sources of information.

The Freight 412 is scanned upon arrival at the cargo handler"s location 416. The shipper is authenticated using a cross check of at least two independent sources of information. The information sources in this illustrative example are a bar code on the package and a data record held by a trusted third party having a central server 424. Additionally, after a security check, status notification and rescheduling information is provided if needed. The information security model may reduce security related costs.

In an initial cubing station 416, the shipper"s parcels are unloaded from the initial short haul trusted shipper"s truck. The parcels are then organized into containers for long haul ground transport 420. The parcels are put on a pedestal 416 and parcel information is obtained using computer 414. In this example, a range laser is used to obtain orientation and dimension information. The laser may also be used to read a package identification field or other data on a package. The pedestal may be a scale for providing weight information. The shipper may have previously provided the weight information and a scale may be used to verify the data. A parcel computer record is created including an Item ID that may be in machine-readable form on or in the package. Additionally, Shipper Information (Shipper ID, Origin, Account number and Address) are included and some of the information may be in machine or human readable form, each of which may be in plain text or encrypted form or any combination thereof. Destination information is included and may be in machine or human readable form, each of which may be in plain text or encrypted form or any combination thereof. Weight information is included and a table for location and time stamps is created that will be filled at each record point along a route. A security declaration field may be created for the shipper to declare a security or safety condition. Additionally, a measured security or safety field is initialized that may be used for comparison with the entered security field.

A parcel condition field is created and payment fields including payment type (pre-paid, billed, etc.) and a payment amount field are created. Other fields may be added such as special instructions for delivery, a particular level of visibility into the data record that various users are allowed and whether sender notification along the route is desired.

In one embodiment, a class of service field and destination field along with the current location field may be used to determine the mode of transportationln an air cargo embodiment, historical usage patterns are interrogated in order to provide statistical utilization data to forecast a particular load. Additionally, shipper reservation data related to likely shipments is utilized for advanced planning. Historical data may be utilized to determine the likelihood that a reserved package will show up as promised. Furthermore, real time tracking information may be utilized to determine whether a particular parcel will make the cut off time for a pallet.

In an embodiment using hand packing and unpacking, the system creates a unique load plan/manifest system that easily allows the warehouse worker to build complicated pallets with simplified and clear instructions. The system also automatically transmits a three dimensional and rotational model of each pallet as part of an electronic manifest system. For example, an operator, for instance in Paris, can virtually unload pallets to get to urgent cargo. They can pinpoint locations of freight in seconds and have an extremely unique tool to use in planning deconsolidation activities in advance. Destination stations are able to more precisely order labor and unloading equipment, which will significantly reduce costs and increase speed if a particular package must be unloaded.

In another alternative applicable to any of the embodiments, each package may be scanned and compared to an electronic bill of lading to ensure that no packages were added or removed.

In another alternative applicable to any of the embodiments, the digital signature and data may be resident in an RF ID tag embedded into the packing material that is not easily removed or replicated and that may include tamper detection and disabling technology.

In one embodiment, the dimension, weight, origination and destination information is used to create a digital signature. A digital signature may be utilized and a public/private key system may also be used for non-repudiation of the package data. A secure hash of the data ensures that any change to the information will result in a different digital signature.

In another alternative applicable to any of the embodiments, information regarding risk profiles for shippers is utilized. A first tier of trusted shippers is processed using the measured data and digital signature method while packages originating from a shipper in a second class of shippers that is not trusted are subjected to physical testing.

In another alternative applicable to any of the embodiments, a response scan is used. The scan parameters such as x-ray source data are stored in the secure data on the package. The source data is read from the package and used to locally measure the response for comparison to the secure response data stored with the package. The package data is authenticated using a digital signature and may also be encrypted.

In another alternative applicable to any of the embodiments, information regarding the package and its anticipated response to stimuli is utilized to test for verification of package integrity. As described above, a response to an electromagnetic wave source is measured. Alternatively, a package may be subjected to force such as shaking to determine if the intended response is received.

In another alternative applicable to any of the embodiments, information regarding the sender location or type of entity is utilized as a security flag such that no packages from such a sender are trusted.

For example, the various processors and communications networks utilized herein may include WINDOWS/INTEL platforms and/or mobile processors including handheld computers and notebook computers. Additionally, LAN and/or WAN Connections may be utilized and wireless or wired communication paths may be utilized.

In another alternative applicable to any of the embodiments, the digital signature-creating device utilizes human readable marking processes rather than machine-readable marking processes.

In another alternative applicable to any of the embodiments, the digital signature device on a package includes a wireless device that includes a token controller having a secure token key storage such as an iButton® available from Dallas Semiconductor in which an attack, for example, a physical attack on the device, results in an erasure of the key information. Passwords may be used, such as a password to access the device. In an alternative, the password may include biometric data read from a user. Alternatively, other secret key or public key systems may be utilized. Additionally, authentication and repudiation systems such as a secure hash including SHA-1 could be utilized and encryption utilizing a private key for decryption by public key for authentication.

The present application describes illustrative embodiments of a system and method for secure package shipment. The embodiments are illustrative and not intended to present an exhaustive list of possible configurations. Where alternative elements are described, they are understood to fully describe alternative embodiments without repeating common elements whether or not expressly stated to so relate. Similarly, alternatives described for elements used in more than one embodiment are understood to describe alternative embodiments for each of the described embodiments having that element.

The described embodiments are illustrative and the above description may indicate to those skilled in the art additional ways in which the principles of this invention may be used without departing from the spirit of the invention. Accordingly, the scope of each of the claims is not to be limited by the particular embodiments described.

The invention claimed is:

1. A computer implemented method for verifying the integrity of a package at an intermediate test and carrier transfer point on a shipping route comprising:

receiving the package from a first carrier at the intermediate test and carrier transfer point;

obtaining package data from the package using a measurement system operatively connected to the computer at the intermediate test and carrier transfer point on the shipping route;

independently obtaining a package data copy by using the computer to access a data storage system used for storing a plurality of package data records received from a shipper measurement system at a trusted shipping point on the shipping route; and comparing the package data obtained from the package with the package data copy in order to provide integrity data using the computer, wherein the intermediate test and carrier transfer point is located beyond the trusted shipping point on the shipping route, wherein the package data comprises an electromagnetic wave response signature associated with a physical change in an electromagnetic wave source signal after it strikes the package; and releasing the package to a second carrier at the intermediate test and carrier transfer point only if the integrity data is satisfactory.

2. The method of claim 1 wherein:

the package data comprises a digital signature authenticating the shipper; and the first carrier adds a record to the package data at the intermediate test and carrier transfer point.

3. The method of claim 2 further comprising:

obtaining the package data copy from a trusted third party.

4. The method of claim 2 further comprising:

obtaining the package data from the digital signature having partial message recovery capability.

5. The method of claim 1 wherein:

the package data comprises weight data and secure time data related to the time the package was processed at the intermediate test and carrier transfer point.

6. The method of claim 1 wherein:

the package data comprises size data and density data.

7. The method of claim 1 wherein:

the electromagnetic wave response signature includes a package response to an x-ray source.

8. The method of claim 7 further comprising:

measuring a local package electromagnetic wave response signature to determine the package copy data.

9. The method of claim 8 further comprising:

obtaining source parameter data from the package data; and measuring the local package electromagnetic wave response signature to determine the package copy data using the source parameter data.

10. The method of claim 9 further comprising:

determining a security parameter based upon the comparison.

11. The method of claim 9 further comprising:

determining a security parameter based upon the comparison and a shipper history parameter, wherein the shipper history parameter is determined using shipper history incident data relating to trustworthiness.

12. The method of claim 11 wherein:

the security parameter comprises at least three security levels.

13. The method of claim 11 wherein:

the shipper history parameter is obtained from a trusted third party.

14. The method of claim 1, further comprising:

then providing a payment release indication for payment to the first carrier only if the integrity data is satisfactory.

* * * * *